US007284594B2

(12) United States Patent
Sanada et al.

(10) Patent No.: US 7,284,594 B2
(45) Date of Patent: Oct. 23, 2007

(54) COOLING SYSTEM USED FOR HYBRID-POWERED AUTOMOBILE

(75) Inventors: Ryouichi Sanada, Oobu (JP); Atsushi Hayasaka, Kariya (JP); Naoki Sugimoto, Anjo (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/149,496

(22) Filed: Jun. 9, 2005

(65) Prior Publication Data

US 2005/0274507 A1 Dec. 15, 2005

(30) Foreign Application Priority Data

Jun. 10, 2004 (JP) ..... 2004-172848
Mar. 15, 2005 (JP) ..... 2005-073438

(51) Int. Cl.

| | |
|---|---|
| ***F28D 1/053*** | (2006.01) |
| ***F28F 9/00*** | (2006.01) |
| ***F28F 9/02*** | (2006.01) |
| ***B60H 1/32*** | (2006.01) |
| ***F01P 3/18*** | (2006.01) |

(52) U.S. Cl. ..... 165/41; 165/51; 165/132; 165/140; 165/67; 165/177; 62/509; 180/65.2; 180/65.4; 180/68.4

(58) Field of Classification Search ..... 165/140, 165/132, 41, 51, 67, 177; 180/65.2, 65.4, 180/68.4; 62/509

See application file for complete search history.

(56) References Cited

U.S. PATENT DOCUMENTS

| | | | | |
|---|---|---|---|---|
| 4,651,816 | A * | 3/1987 | Struss et al. | 165/76 |
| 6,044,900 | A * | 4/2000 | Kawahara | 165/132 |
| 6,173,766 | B1 | 1/2001 | Nakamura et al. | |
| 6,616,059 | B2 * | 9/2003 | Sabhapathy et al. | 180/65.2 |
| 6,789,613 | B1 * | 9/2004 | Ozaki et al. | 165/140 |
| 2002/0040776 | A1 | 4/2002 | Kokubunji et al. | |
| 2002/0056541 | A1 * | 5/2002 | Kokubunji et al. | 165/67 |
| 2004/0206474 | A1 * | 10/2004 | Watanabe et al. | 165/140 |
| 2005/0217831 | A1 * | 10/2005 | Manaka | 165/140 |

FOREIGN PATENT DOCUMENTS

| | | | |
|---|---|---|---|
| JP | 04121562 | A * | 4/1992 |
| JP | 06159976 | A * | 6/1994 |
| JP | 10-206074 | | 8/1998 |
| JP | 10-259721 | | 9/1998 |
| JP | 11051587 | A * | 2/1999 |
| JP | 2000046490 | A * | 2/2000 |
| JP | 2001-059420 | | 3/2001 |
| JP | 2001059420 | A * | 3/2001 |
| JP | 2001-174168 | | 6/2001 |
| JP | 2001-174190 | | 6/2001 |
| JP | 2002-115991 | | 4/2002 |
| JP | 2003-34130 | | 2/2003 |

* cited by examiner

OTHER PUBLICATIONS

Office Action from co-pending Chinese Application No. 200510076105.6 dated Jun. 30, 2006 with English translation.

*Primary Examiner*—John K. Ford
(74) *Attorney, Agent, or Firm*—Harness, Dickey & Pierce, PLC

(57) ABSTRACT

A radiator 9 for electric parts use, which cools an inverter and others relating to the control of an electric motor, and a condenser 12 for condensing refrigerant are arranged in parallel with each other with respect to the direction of an air flow on an upstream side of the air flow of a radiator 8 for engine use. Due to the above arrangement, as the air temperatures at the inlets of the radiator 8 for electric parts use and the condenser 12 are low, a temperature difference between air and cooling water and a temperature difference between air and refrigerant are increased, and it becomes possible to enhance the performance of the radiator 8 for electric parts use and the condenser 12.

5 Claims, 10 Drawing Sheets

COOLING SYSTEM USED FOR HYBRID-POWERED AUTOMOBILE

BACKGROUND OF THE INVENTION

1. Field of the Invention

The present invention relates to a cooling system used for a hybrid-powered automobile which is driven by a combination of a water-cooled engine and an electric motor.

2. Description of the Related Art

The cooling system used for a hybrid-powered automobile includes: a radiator for engine use which cools an engine; and a radiator for electric parts use which cools electric parts such as an inverter and also cools an electric motor. In some cases, the cooling system used for a hybrid-powered automobile further includes a condenser which cools the gas-phase refrigerant, at a high temperature, flowing in an air-conditioner.

In the case where the above three heat exchangers are provided in the cooling system used for a hybrid-powered automobile, the radiator for cooling electric parts, the condenser for cooling the gas-phase refrigerant and the radiator for cooling the engine are arranged in series in this order in the flow of air, that is, a so-called three row mounting type cooling system is put into practical use.

There is also a cooling system in which the radiator for cooling the engine and the radiator for cooling electric parts are arranged on the same plane, that is, the radiator for cooling the engine and the radiator for cooling electric parts are arranged in parallel with each other with respect to the air flow direction. For example, this cooling system is disclosed in the official gazette of JP-A-10-259721. In the case where the three heat exchangers are provided, the cooling system has been put into practical use in which the radiator for-cooling the engine and the radiator for cooling electric parts are arranged on the same plane and the condenser is arranged on the upstream side of the air flow with respect to the radiator for cooling the engine and the radiator for cooling electric parts.

However, in the case of the above three row mounting type cooling system, the length of the cooling system is extended in the longitudinal direction of the vehicle. Therefore, problems are caused when the three row mounting type cooling system is mounted on the vehicle.

In this connection, in order to cool electric parts, such as an inverter circuit, to an appropriate temperature, it is necessary to maintain the temperature of cooling water circulating in the radiator for cooling the electric parts at about 60° C. The temperature of the refrigerant in the condenser is approximately 70° C., and the temperature of the cooling water in the radiator for cooling the engine is approximately 100° C. In other words, the cooling water temperature of the radiator for cooling the electric parts is substantially the same as the refrigerant temperature of the condenser. Due to the foregoing, the following problems may be encountered.

In the case of the three row mounting type cooling system in which the condenser is arranged on the downstream side of the air flow of the radiator for cooling the electric parts, as heat is radiated from the radiator for cooling the electric parts, the air temperature at the inlet of the condenser is raised, and a temperature difference between the air and the refrigerant is reduced. Therefore, it becomes impossible for the condenser to exhibit a necessary cooling performance.

On the other hand, in the case where the radiator for engine use and the radiator for electric parts use are arranged on the same plane, the air temperature at the inlet of the radiator for electric parts use is raised by the heat radiated from the condenser, and a temperature difference between the air and the cooling water is reduced. Therefore, it becomes impossible for the radiator for electric parts use to exhibit a necessary cooling performance.

When the inverter capacity is enhanced in order to increase an output of the hybrid-powered automobile, the radiator for the electric parts use is made larger in size according to an increase in the required capacity. In the case where the radiator for engine use and the radiator for electric parts use are arranged on the same plane, it becomes necessary to reduce the size of the radiator for engine use to correspond to an increase in the size of the radiator for electric parts use. Accordingly, the following problem may be encountered. A quantity of heat to be radiated from the radiator for engine use becomes insufficient.

SUMMARY OF THE INVENTION

In view of the above points, it is an object of the present invention to enhance the performance of a radiator for electric parts use and a condenser in a cooling system used for a hybrid-powered automobile having three heat exchangers. It is also an object of the present invention to enhance the property of mounting the radiator for electric parts use and the condenser on a vehicle.

In order to accomplish the above object, according to a first aspect of the present invention, there is provided a cooling system for a hybrid-powered automobile, the hybrid-powered automobile having an air conditioner (10) for cooling air, which is blown into a vehicle compartment, by utilizing latent heat of evaporation of refrigerant, the hybrid-powered automobile being driven by a combination of a water-cooled engine (1) and electric motor (2), the cooling system for a hybrid-powered automobile comprising: a radiator (8) for engine use for exchanging heat between cooling water, which has cooled the water-cooled engine (1), and air so as to cool the cooling water; a radiator (9) for electric parts use for exchanging heat between cooling water, which has cooled electric parts (6) relating to the control of the electric motor (2), and air so as to cool the cooling water; and a condenser (12) for exchanging heat between the refrigerant at a high temperature and air so as to condense the refrigerant, wherein the radiator (9) for electric parts use and the condenser (12) are arranged in parallel with each other with respect to the direction of the air flow on the upstream side of the air flow of the radiator (8) for engine use.

Due to the foregoing, the air temperatures at the inlets of the radiator for electric parts use and the condenser are low. Therefore, a temperature difference between the air and the cooling water is made larger, and a temperature difference between the air and the refrigerant is also made larger. Accordingly, it becomes possible to enhance the performance of the radiator for electric parts use and the condenser.

As the performance of the radiator for electric parts use and the condenser can be enhanced, it becomes possible to reduce a volume of air flowing in each heat exchanger. Accordingly; it becomes possible to reduce the capacity of each electric fan for supplying air to each heat exchanger. Therefore, the electric power consumption of the electric fans can be reduced and, further, the electric fans can be made lighter in weight.

As three heat exchangers are arranged in two rows, the length of the heat exchangers in the longitudinal direction of the vehicle is shorter than that of the case in which three heat exchangers are arranged in three rows. Accordingly, the heat exchangers can be more easily mounted on the vehicle.

According to a second aspect of the present invention, the radiator (9) for electric parts use and the condenser (12) are composed separately from each other and are detachably combined with each other.

Due to the above structure, in the case where one of the radiator for electric parts use and the condenser is damaged, only the damaged heat exchanger need be replaced and the other heat exchanger can be successively used.

According to a third aspect of the present invention, the radiator (9) for electric parts use includes a large number of cooling water tubes (91), inside of which the cooling water flows and outside of which air flows, and also includes a cooling water header tank (93) for distributing the cooling water to the cooling water tubes (91) or collecting the cooling water from the cooling water tubes (91), the condenser (12) includes a large number of refrigerant tubes (121), inside of which the refrigerant flows and outside of which air flows, and also includes a refrigerant header tank (123) for distributing the refrigerant to the refrigerant tubes (121) or collecting the refrigerant from the refrigerant tubes (121), and the cooling water header tank (93) and the refrigerant header tank (123) are integrated with each other into one body.

Due to the foregoing, in a heat exchanger in which the core portion including tubes and fins is joined to the header tank by means of soldering, when both the core portion of the radiator for electric parts use and the core portion of the condenser are assembled and soldered to the integrated header tank, it is possible to simultaneously conduct the soldering process of the radiator for electric parts use and the soldering process of the condenser. Accordingly, the manufacturing process can be simplified and the manufacturing cost can be reduced.

According to a fourth aspect of the present invention, the condenser (12) is disposed below the radiator (9) for electric parts use, the condenser (122) comprises a plurality of refrigerant tubes (121) in which multiple cooling water passages (91*a*), in which a cooling water flows, are formed in parallel, and wherein the plurality of refrigerant tubes (121) are laminated and disposed so that air flows between the plurality of refrigerant tubes (121), and wherein in the refrigerant tube (122), the wall thickness measured in the air-flow direction in this refrigerant tube (121) is larger than the wall thickness measured in the tubes-laminated direction in this refrigerant tube (121).

Due to the foregoing, the fact that in the refrigerant tube of the condenser disposed below the radiator 9 for electric parts use, the air-flow direction side of the refrigerant tube 121 in the condenser 12, that is, a portion which is likely to be hit by pebbles from a road surface is thick and is made of a so-called perforated tube, which has a high strength can make the refrigerant tube hard to be broken even if pebbles from a road surface hits the condenser (chipping).

According to a fifth aspect of the present invention, the condenser (12) includes a condenser portion (127) for condensing gas-phase refrigerant, a modulator (128) for separating the refrigerant, which has flowed out from the condenser portion (127), into gas-phase refrigerant and liquid-phase refrigerant, and a sub-cooler portion (129) for cooling the liquid-phase refrigerant which has flowed out from the modulator (128), and the radiator (9) for electric parts use is arranged in an upper portion of the condenser (12).

In this connection, in the common layout of a condenser having a condenser portion, a modulator and a sub-cooler portion, the modulator is arranged on the sides of the condenser portion and the sub-cooler portion, and an upper portion of the modulator protrudes from an upper end face of the condenser portion. Therefore, a useless space is formed in an upper portion of the condenser portion.

Therefore, as described in the fourth aspect of the present invention, when the radiator for electric parts use is arranged in the upper portion of the condenser, it is possible to effectively utilize the useless space formed in the upper portion of the condenser portion, and the heat exchangers can be more easily mounted on a vehicle.

According to a sixth aspect of the present invention, the modulator (128) is arranged on the sides of the condenser (12), and an upper portion of the modulator (128) protrudes upward with respect to an upper end face of the condenser (12), and the upper portion side of the modulator (128) is fixed to the radiator (9) for electric parts use, and the lower portion side of the modulator (128) is fixed to the condenser (12).

Due to the foregoing, swing of the modulator due to a vehicle vibration is suppressed so that the modulator can be prevented from contacting a radiator for engine use.

Incidentally, the reference numerals in parentheses, to denote the above means, are intended to show the relationship of the specific means which will be described later in an embodiment of the invention.

The present invention may be more fully understood from the description of preferred embodiments of the invention set forth below, together with the accompanying drawings.

DESCRIPTION OF PREFERRED EMBODIMENTS

Figure 1:
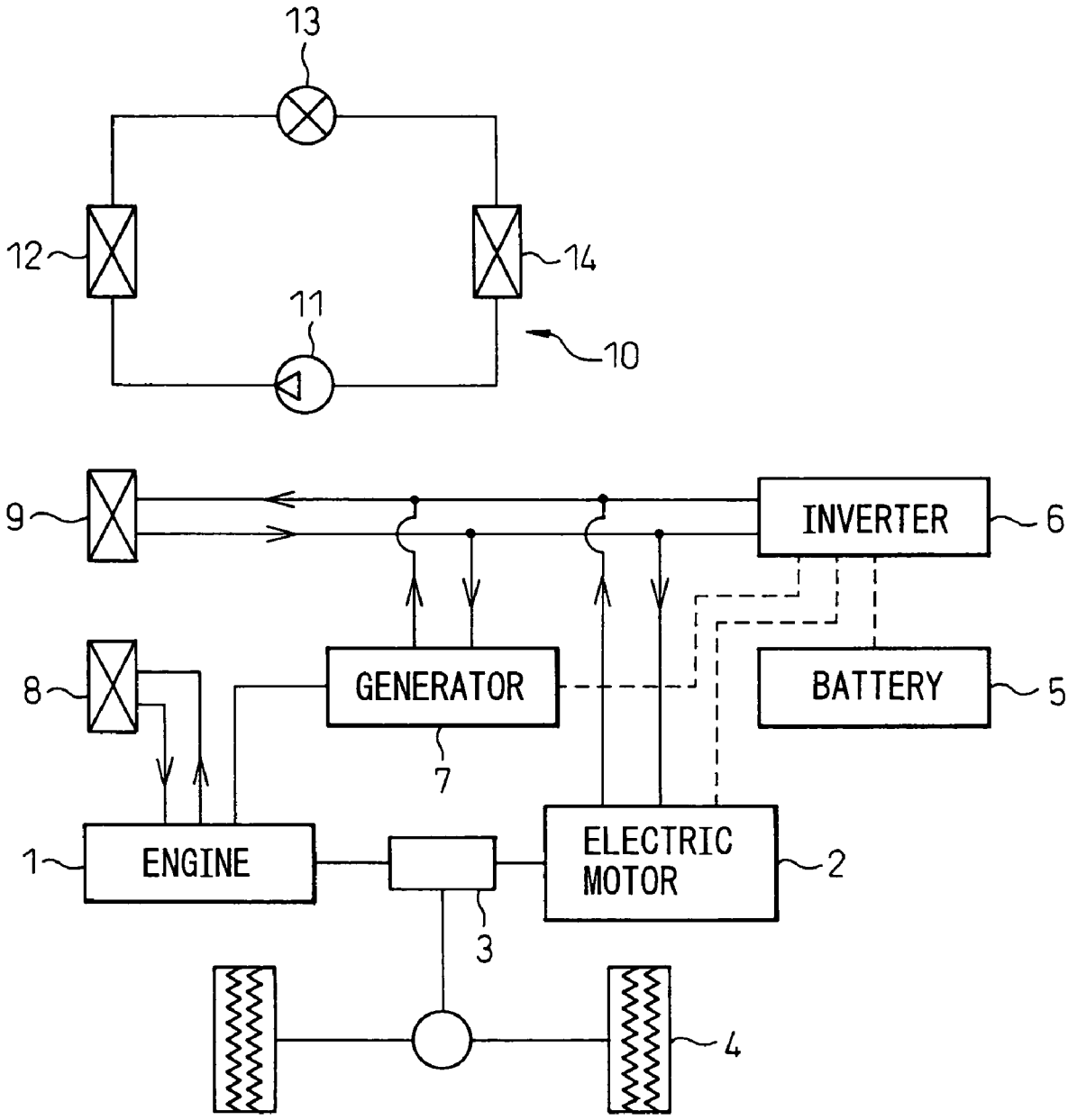
FIG. 1 is a schematic illustration of a hybrid-powered automobile on which a cooling system of the first embodiment of the present invention is mounted.
Figure 2:
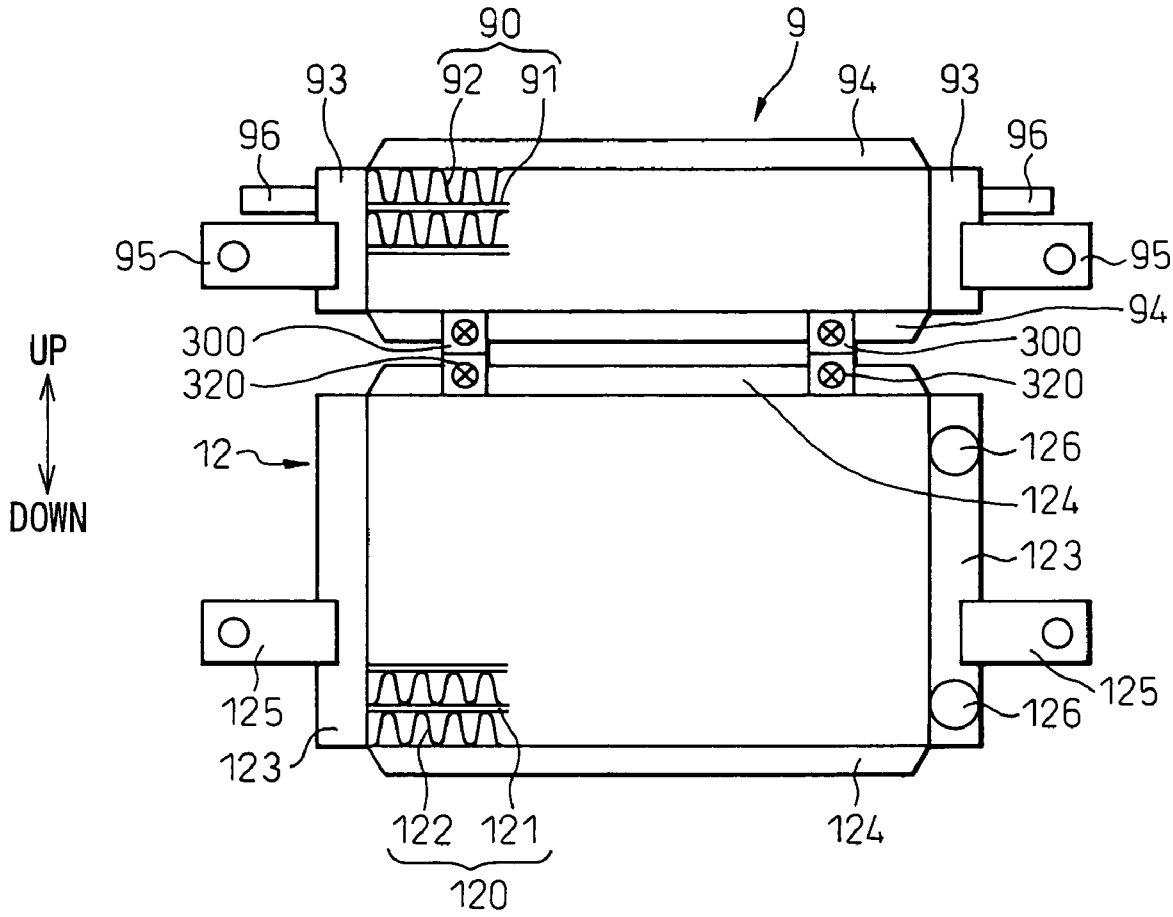
FIG. 2 is a front view in which the cooling system of the first embodiment is viewed from the front of a vehicle.
Figure 3:
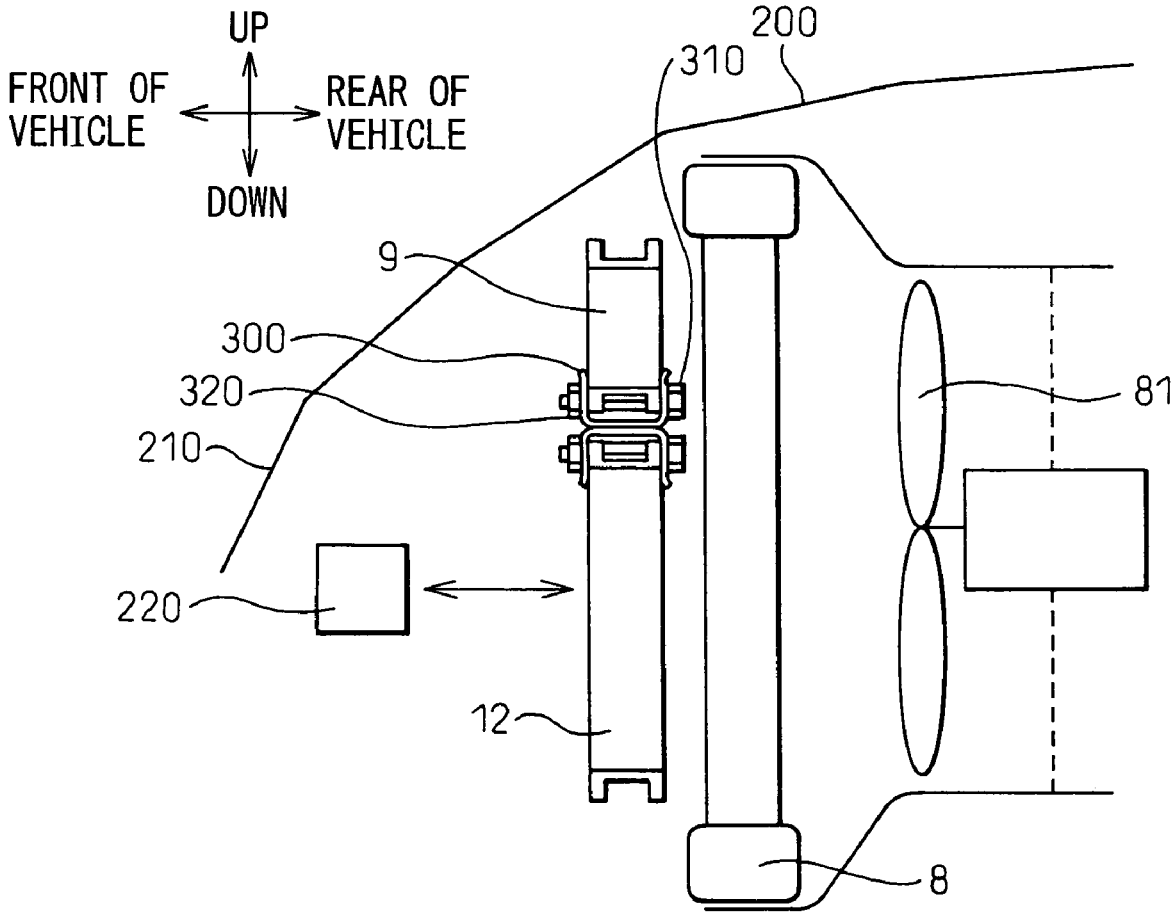
FIG. 3 is a side view showing a state in which the cooling system shown in FIG. 2 is mounted on a vehicle.

The first embodiment of the present invention will be explained below. FIG. 1 is a schematic illustration of a hybrid-powered automobile on which a cooling system of the first embodiment of the present invention is mounted, FIG. 2 is a front view in which the cooling system of the first embodiment is viewed from the front of a vehicle and FIG. 3 is a side view showing a state in which the cooling system shown in FIG. 2 is mounted on a vehicle.

As shown in FIG. 1, the hybrid-powered automobile includes an internal-combustion engine 1 and an electric motor 2 which are power sources to drive a vehicle. The driving power generated by the engine 1 and the electric motor 2 is transmitted to the drive wheels 4 via the transmission 3. Electric power is supplied to the electric motor 2 from the secondary battery 5 via the inverter 6. At this time, the inverter 6 converts the DC voltage of the secondary battery 5 into an AC voltage and changes the frequency of AC voltage so that the rotary speed of the electric motor 2 can be controlled. In this connection, the inverter 6 corresponds to an electric part of the present invention.

When the vehicle is decelerated or the remaining electric charge in the secondary battery 5 is reduced to a value not more than a predetermined value, the generator 7 is driven by the engine 1 so as to generate electric power. Electric power generated by this generator 7 is supplied to the secondary battery 5 via the inverter 6. In this way, the secondary battery 5 is electrically charged.

Cooling water to cool the engine 1 is circulated in a cooling water circuit including the radiator 8 for cooling the engine. In the radiator 8 for cooling the engine, heat is exchanged between the cooling water, the temperature of which is raised when it cools the engine 1, and the outside air, so that the cooling water can be cooled.

The cooling water to cool the electric motor 2, the inverter 6 and the generator 7 is circulated in the radiator 9 for electric parts use. The radiator 9 for electric parts use exchanges heat between the cooling water, the temperature of which is raised when it cools the electric motor 2, and the outside air, so that the cooling water can be cooled.

The hybrid-powered automobile of this embodiment is provided with an air conditioner 10 for cooling air, which blows into the vehicle compartment, by utilizing the latent heat of vaporization of the refrigerant. The air conditioner 10 includes: a compressor 11 driven by the engine or the electric motor not shown so that the gas-phase refrigerant can be compressed; a condenser 12 for exchanging heat between the refrigerant at a high temperature and pressure, which is discharged from the compressor 11, and the outside air so that the refrigerant can be cooled and condensed; a decompressor 13 for decompressing the liquid-phase refrigerant which has flowed out from the condenser 2; and an evaporator 14 for absorbing heat from the air blown out into the vehicle compartment so that the refrigerant decompressed by the decompressor 13 can be evaporated.

Next, three heat exchangers, which are the radiator 8 for engine use, the radiator 9 for electric parts use and the condenser 12, will be described in detail as follows.

As shown in FIGS. 2 and 3, three heat exchangers are mounted below the hood 200 on the rear side of the radiator grill 210 and the bumper reinforcing member 220 of the vehicle.

The radiator 9 for electric parts use and the condenser 12 are arranged in parallel with each other with respect to the air flow direction. In this embodiment, the radiator 9 for electric parts use is arranged on the upper side of the condenser 12. The radiator 8 for engine use is located on the downstream side of the air flow with respect to the radiator 9 for electric parts use and the condenser 12. The radiator 8 for engine use is located at a position so that the radiator 8 can overlap with the radiator 9 for electric parts use and the condenser 12 when it is viewed in the air flow direction. On the downstream side of the radiator 8 for engine use, the electric fan 81 is arranged which supplies air for cooling to each heat exchanger.

The radiator 9 for electric parts use is composed in such a manner that a large number of cooling water tubes 91, in which the cooling water flows, are laminated on each other and the fins 92 for facilitating heat-exchange between the cooling water and the outside air are arranged between the adjoining cooling water tubes 91. The core portion 90 is composed of these cooling water tubes 91 and fins 92.

On both end sides in the longitudinal direction of the cooling water tubes 91, the cooling water header tanks 93 are provided which communicate with all the cooling water tubes 91 and distribute the cooling water to the cooling water tubes 91 or collect the cooling water from the cooling water tubes 91. On both end sides in the laminating direction of the cooling water tubes 91, the side plates 94 are provided which extend in parallel with the cooling water tubes 91 and reinforce the core portion 90.

The attaching brackets 95 for attaching the radiator 9 for electric parts use to the vehicle body (not shown) or to the radiator 8 for engine use are joined to the cooling water header tank 93. Alternatively, the pipes 96 are joined to the cooling water header tanks 93. These pipes 96 are connected to a cooling water pipe (not shown) which connects the radiator 9 for electric parts use with the electric motor 2, the inverter 6 and the generator 7.

Concerning the radiator 9 for electric parts use, all parts composing the radiator 9 are made of, for example, aluminum alloy and are joined into one body by means of soldering. In this connection, the radiator 9 for electric parts use of this embodiment is of the cross-flow type in which the cooling water flows in the horizontal direction.

In the condenser 12, a large number of refrigerant tubes 121, in which the refrigerant flows, are laminated on each other, and the fins 122 for facilitating heat exchange between the refrigerant and the outside air are arranged between the adjoining tubes 121. The core portion 120 is composed of these refrigerant tubes 121 and the fins 122.

On both end sides in the longitudinal direction of the refrigerant tubes 121, the refrigerant header tanks 123 are provided which communicate with all the refrigerant tubes 121 and distribute the refrigerant to the refrigerant tubes 121 or collect the refrigerant from the refrigerant tubes 121. On both end sides in the laminating direction of the refrigerant tubes 121, the side plates 124 are provided which extend in parallel with the refrigerant tubes 121 and reinforce the core portion 120.

The attaching brackets 125 for attaching the condenser 12 to the vehicle body (not shown) or to the radiator 8 for engine use are joined to the refrigerant header tank 123. The connector 126 is joined to the refrigerant header tank 123. The refrigerant pipe (not shown) for connecting the compressor 11 and the decompressor 13 with the condenser 12 is connected to this connector 126.

Concerning the condenser 12, all parts composing the condenser 12 are made of, for example, aluminum alloy and are joined into one body by means of soldering. In this connection, the condenser 12 of this embodiment is of the cross-flow type in which the cooling water flows in the horizontal direction.

The radiator 9 for electric parts use and the condenser 12 are joined to each other by the joining bracket 300, the bolt 310 and the nut 320. In more detail, after the bolt 310 has been inserted into the hole 124 (not shown) on the side plate 94 and the hole (not shown) of the joining bracket 300, the bolt 310 is screwed into the nut 320. Accordingly, the radiator 9 for electric parts and the condenser 12 can be separated from each other when the bolt 310 is detached.

The radiator 9 for electric parts and the condenser 12, which are joined to each other by the joining bracket 300, are attached to the vehicle body or the radiator 8 for engine use by utilizing the attaching brackets 95, 125.

In the above constitution, the outside air which has flowed from the radiator grill 210 into the engine room, first flows into the radiator 9 for electric parts use and the condenser 12. In the radiator 9 for electric parts use, heat is exchanged between the cooling water, the temperature of which is raised when it cools the electric motor 2 and others, and the outside air so that the cooling water can be cooled. In the condenser 12, heat is exchanged between the refrigerant at a high temperature and pressure, which has been discharged from the compressor 11, and the outside air so that the refrigerant can be cooled and condensed.

The air which has passed through the radiator 9 for electric parts use and the condenser 12 flows into the radiator 8 for engine use, and the radiator 8 for engine use cools the cooling water by exchanging heat between the cooling water, the temperature of which has been raised when it cools the engine 1, and the outside air.

According to this embodiment, the temperature of the air flowing into the radiator 9 for electric parts use and the condenser 12 is so low that a temperature difference between the air and the cooling water becomes large and a temperature difference between the air and the refrigerant also becomes large. Accordingly, the performance of the radiator 9 for electric parts use and the condenser 12 can be enhanced.

When the performance of the radiator 9 for electric parts use and the condenser 12 is enhanced, it is possible to reduce a flow rate of the air passing through each heat exchanger. Therefore, the capacity of the electric fan 81 for supplying the air to each heat exchanger can be reduced. Accordingly, the electric power consumption and the weight of the electric fan 81 can be reduced.

As three heat exchangers are arranged in two rows, the length in the longitudinal direction with respect to the vehicle is shorter than that of the heat exchangers arranged in three rows. Therefore, the heat exchangers arranged in two rows can be more easily mounted on the vehicle.

The radiator 9 for electric parts use and the condenser 12 can be separated from each other when the bolts 310 are detached. Due to the above structure, in the case where one of the radiator 9 for electric parts use and the condenser 12 is damaged, only the damaged heat exchanger need be replaced and the other heat exchanger can be successively used.

Also, as the radiator 9 for electric parts use is disposed rearward with respect to the bumper reinforcing member 220, an outside air can easily flow into the radiator 9 for electric parts use, and a cooling performance of the radiator 9 for electric parts use can be ensured.

Figure 4:
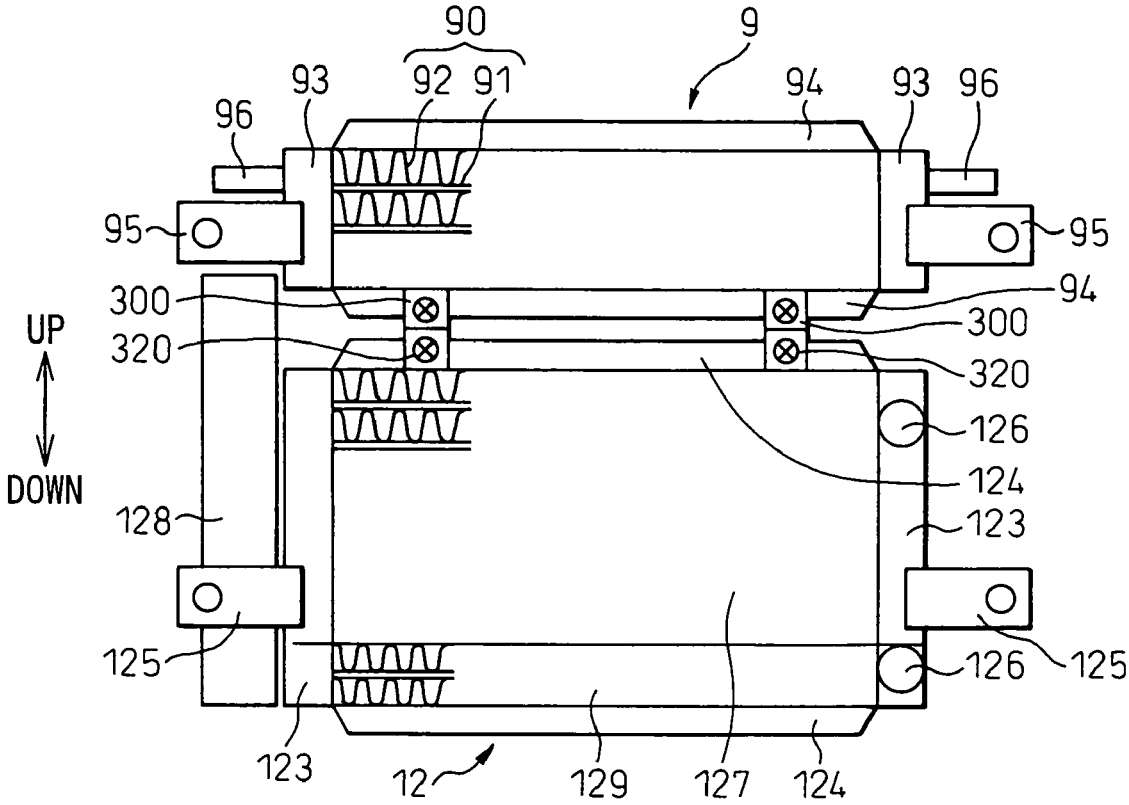
FIG. 4 is a front view in which the cooling system of the second embodiment is viewed from the front of a vehicle.

The second embodiment of the present invention will be explained below. FIG. 4 is a front view in which the cooling system of the second embodiment is viewed from the front of a vehicle. In this connection, similar reference characters are used to indicate similar parts in the first and the second embodiment, and the explanations are omitted here.

The structure of the condenser 12 of this embodiment is different from that of the first embodiment. As shown in FIG. 4, the condenser 12 of this embodiment is a so-called sub-cool condenser. The condenser 12 includes: a condenser portion 127 for exchanging heat between the gas-phase refrigerant, which has been discharged from the compressor 11, and the outside air so as to condense the refrigerant; a modulator 128 for separating the refrigerant, which has flowed out from the condenser portion 127, into the gas-phase refrigerant and the liquid-phase refrigerant; and a sub-cooler portion 129 for cooling the liquid-phase refrigerant which has flowed out from the modulator 128.

Both the condenser portion 127 and the sub-cooler portion 129 are of the cross-flow type. The sub-cooler portion 129 is arranged below the condenser portion 127, and the modulator 128 is arranged on the sides of the condenser portion 127 and the sub-cooler portion 129. An upper portion of the modulator 128 protrudes upward with respect to an upper end face of the condenser portion 127. In an upper portion of the condenser 12, the radiator 9 for electric parts use is arranged.

According to this embodiment, when the radiator 9 for electric parts use is arranged in the upper portion of the condenser 12, it is possible to effectively utilize a useless space in the upper portion of the condenser portion 127. Therefore, the heat exchangers can be more easily mounted on the vehicle.

Figure 5:
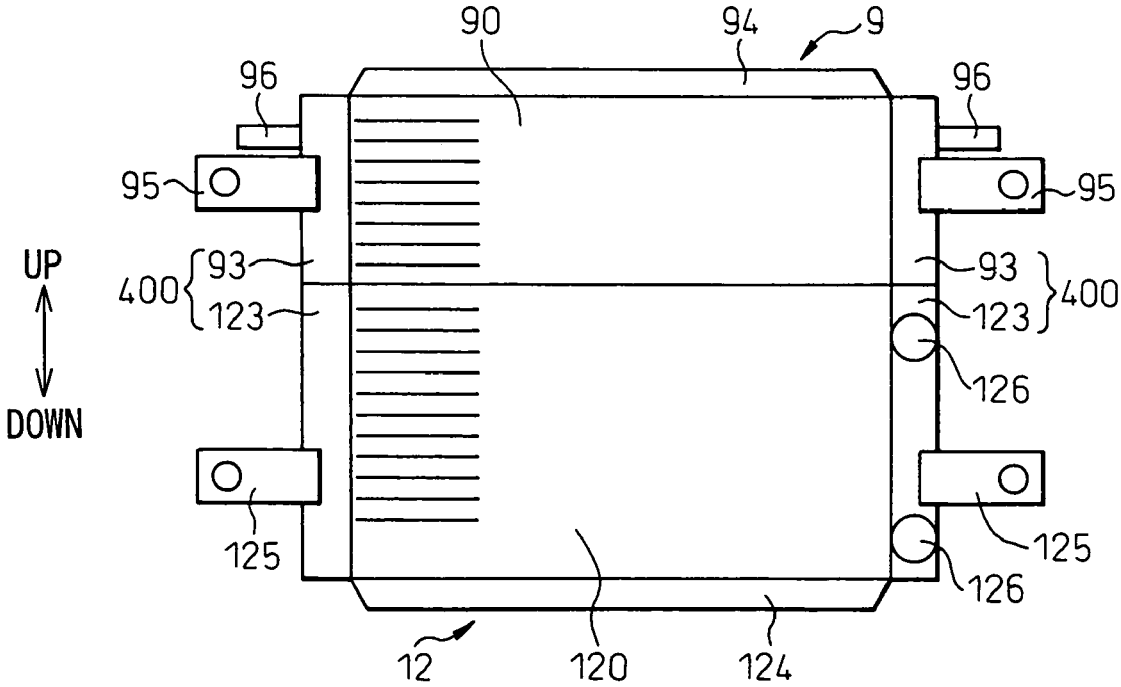
FIG. 5 is a front view in which the cooling system of the third embodiment is viewed from the front of a vehicle.

The third embodiment of the present invention will be explained below. FIG. 5 is a front view in which the cooling system of the third embodiment is viewed from the front of a vehicle. In this connection, similar reference characters are used to indicate similar parts in the first and the third embodiment, and the explanations are omitted here.

As shown in FIG. 5, according to this embodiment, the cooling water header tank 93 of the radiator 9 for electric parts use and the refrigerant header tank 123 of condenser 12 are integrated with each other into one body.

This integrated type header tank 400 includes: a tank body which is formed out of a plate member by means of press forming; and a partitioning member joined to this tank body. More particularly, this integrated type header tank 400 is composed as follows. When one piece of plate member is press-formed and a rectangular parallelepiped tank body, one face of which is open, is formed, and an inner space of the tank body is divided by a partitioning member into a space, which is communicated with the cooling water tube 91 of the radiator 9 for electric parts use, and a space which is communicated with the refrigerant tube 121 of the condenser 12.

When the core portion 90 of the radiator 9 for electric parts use and the core portion 120 of the condenser 12 are assembled and soldered to the integrated type header tank 400, the step of soldering the radiator 9 for electric parts use and the soldering step of soldering the condenser 12 can be simultaneously conducted. As the manufacturing process can be simplified as described above, the manufacturing cost can be reduced.

In this connection, both the radiator 9 for electric parts use and the condenser 12 of this embodiment are of the cross-flow type. However, it is possible to apply this embodiment to the radiator 9 for electric parts use and the condenser 12 of the down-flow type in which the cooling water flows in the vertical direction.

Figure 6:
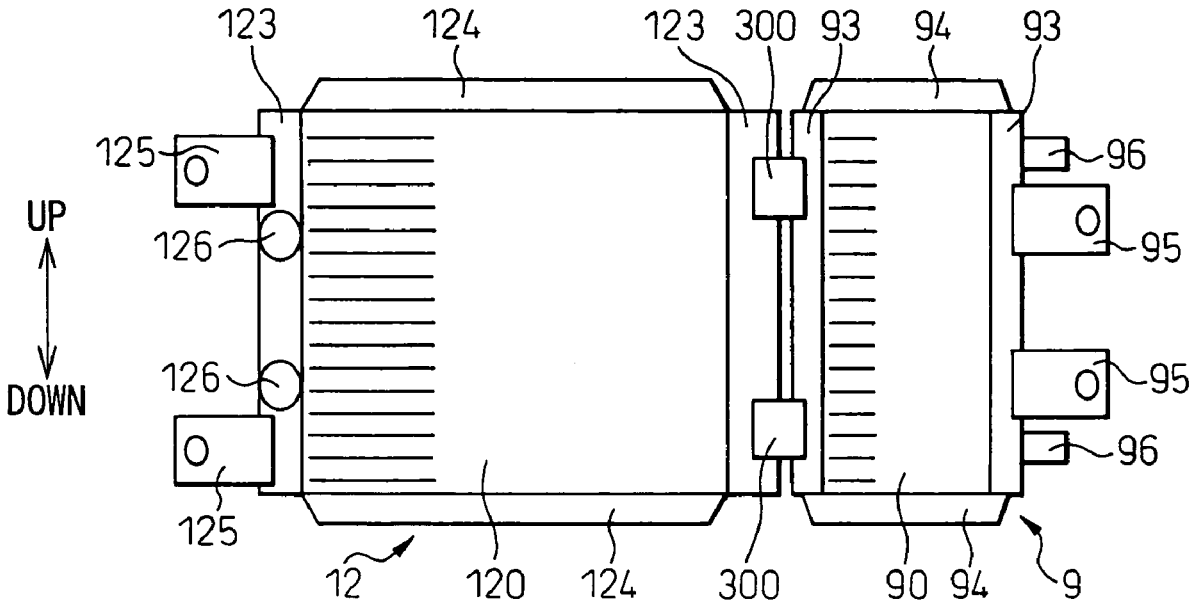
FIG. 6 is a front view in which the cooling system of the fourth embodiment is viewed from the front of a vehicle.

The fourth embodiment of the present invention will be explained below. FIG. 6 is a front view in which the cooling system of the fourth embodiment is viewed from the front of a vehicle. In this connection, similar reference characters are used to indicate similar parts in the first and the fourth embodiment, and the explanations are omitted here.

In this embodiment, the radiator 9 for electric parts use and the condenser 12 are arranged differently from those of the first embodiment. As shown in FIG. 6, the radiator 9 for electric parts use and the condenser 12 may be arranged in the traverse direction of the vehicle.

Figure 7:
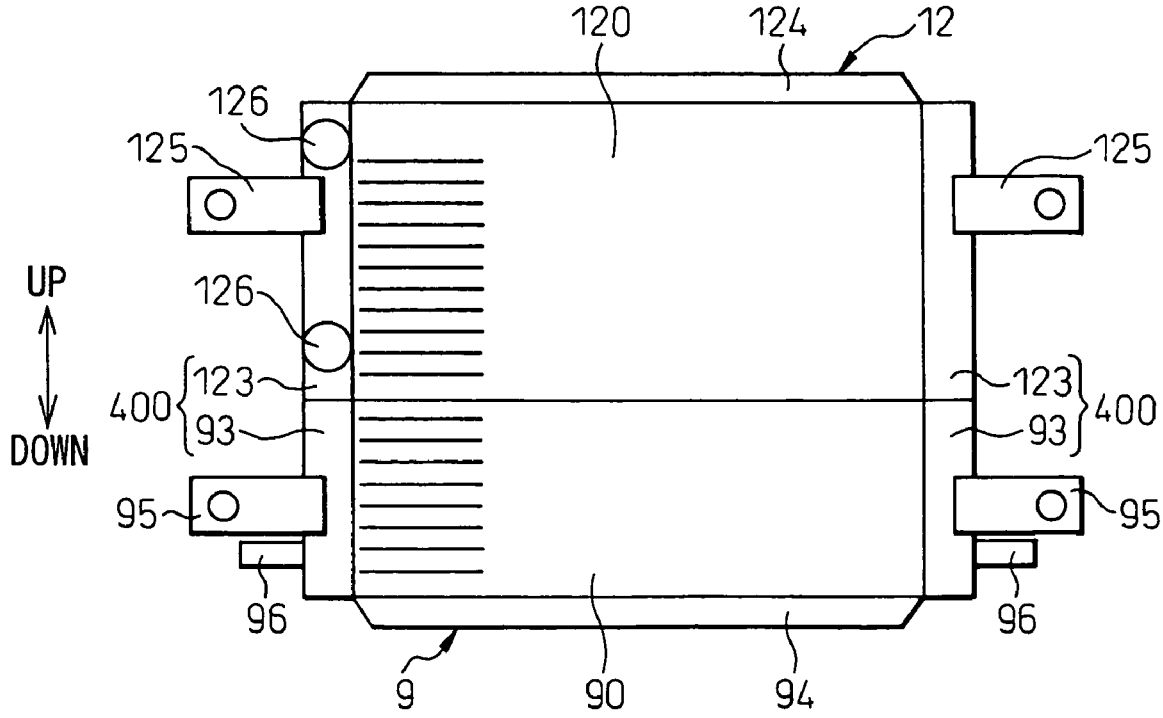
FIG. 7 is a front view in which the cooling system of the fifth embodiment is viewed from the front of a vehicle.

The fifth embodiment of the present invention will be explained below. FIG. 7 is a front view in which the cooling system of the fifth embodiment is viewed from the front of a vehicle. In this connection, similar reference characters are used to indicate similar parts in the third embodiment (shown in FIG. 5) and the fifth embodiment, and the explanations are omitted here.

In this embodiment, the radiator 9 for electric parts use and the condenser 12 are arranged differently from those of the third embodiment. As shown in FIG. 7, the condenser 12 may be arranged on an upper side of the radiator 9 for electric parts use.

Figure 8:
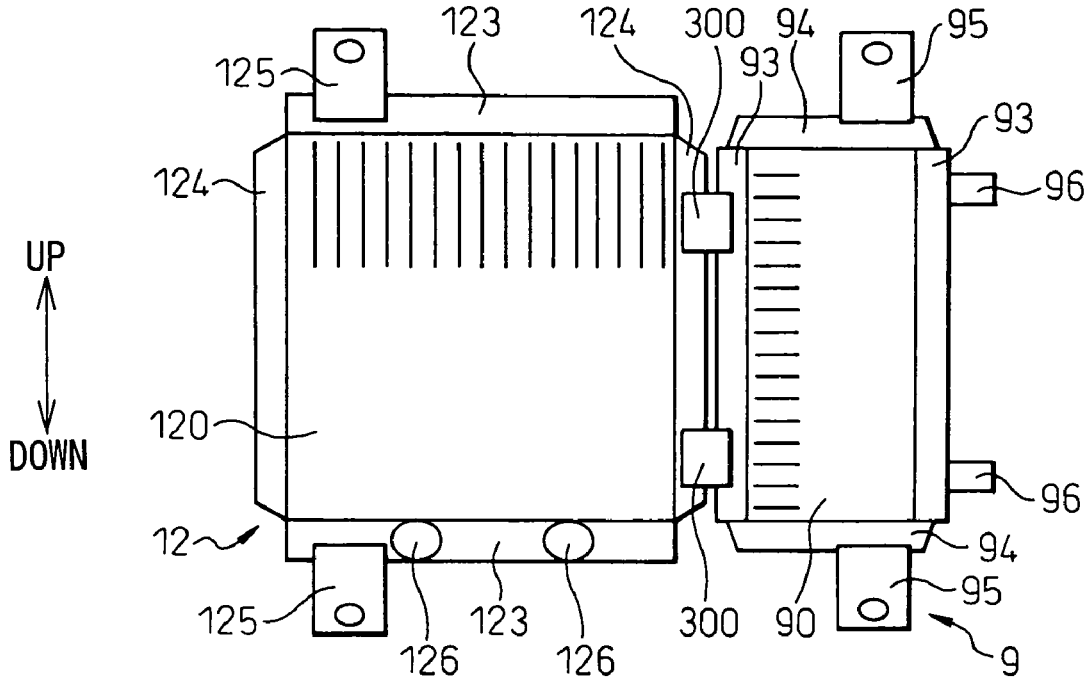
FIG. 8 is a front view in which the cooling system of the sixth embodiment is viewed from the front of a vehicle.
Figure 9:
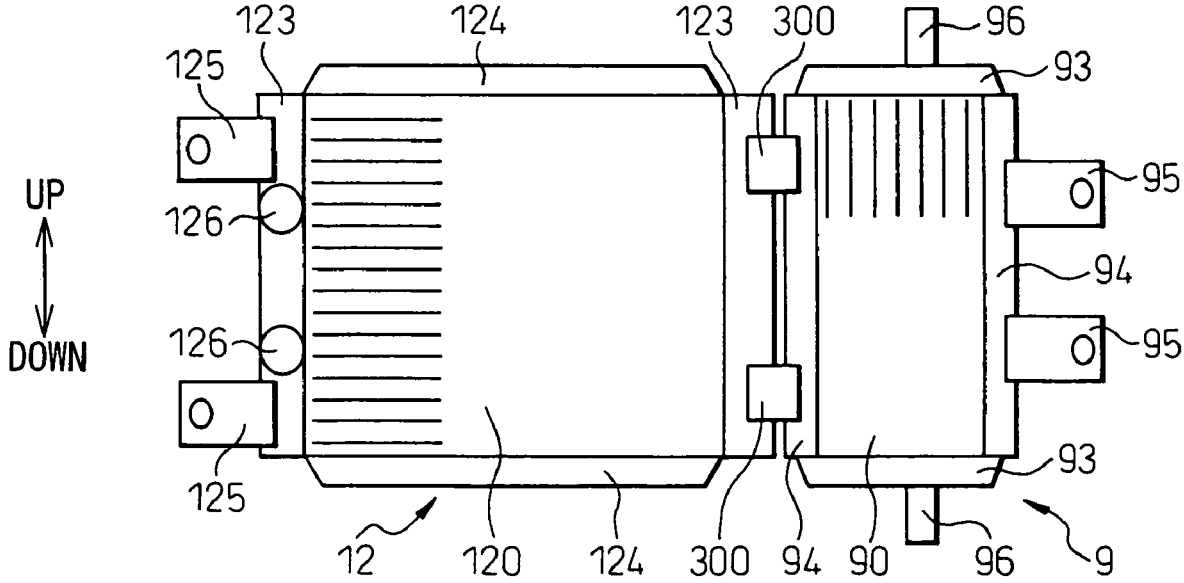
FIG. 9 is a front view in which the cooling system of the seventh embodiment is viewed from the front of a vehicle.

The sixth and the seventh embodiment of the present invention will be explained below. FIG. 8 is a front view in which the cooling system of the sixth embodiment is viewed from the front of a vehicle, and FIG. 9 is a front view in which the cooling system of the seventh embodiment is viewed from the front of a vehicle. In this connection, similar reference characters are used to indicate similar parts in the fourth embodiment (shown in FIG. 6) and the sixth and the seventh embodiment, and the explanations are omitted here.

In the third embodiment, the radiator 9 for electric parts use and the condenser 12 are of the cross-flow type. However, only the condenser 12 may be changed into the down-flow type as in the sixth embodiment shown in FIG. 8. Further, only the radiator 9 for electric parts use may be changed into the down-flow type as in the seventh embodiment shown in FIG. 9.

Figure 10:
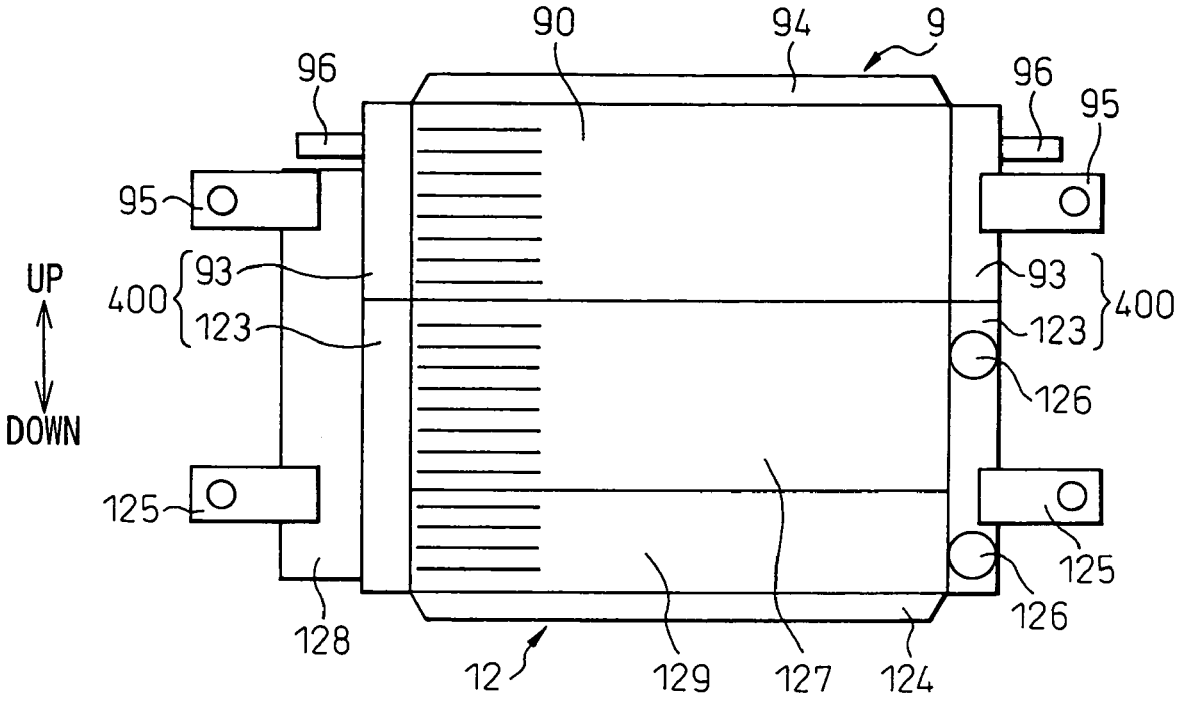
FIG. 10 is a front view in which the cooling system of the eighth embodiment is viewed from the front of a vehicle.

The eighth embodiment of the present invention will be explained below. FIG. 10 is a front view in which the cooling system of the eighth embodiment is viewed from the front of a vehicle. In this connection, similar reference characters are used to indicate similar parts in the second embodiment (shown in FIG. 4) and the eighth embodiment, and the explanations are omitted here.

As shown in FIG. 10, in the case where the condenser 12 is a so-called sub-cool condenser, the cooling water header tank 93 of the radiator 9 for electric parts use and the refrigerant header tank 123 of the condenser 12 can be integrated with each other into one body. This integrated type header tank 400 includes: a tank body which is formed out of a plate member by means of press forming; and a partitioning member joined to this tank body.

Figure 11:
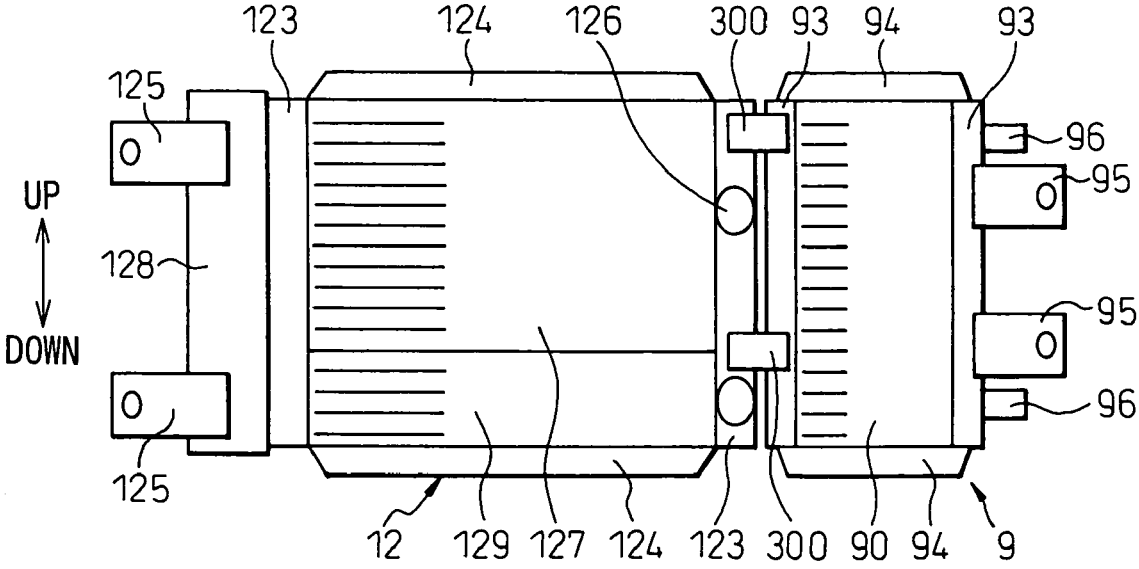
FIG. 11 is a front view in which the cooling system of the ninth embodiment is viewed from the front of a vehicle.

The ninth embodiment of the present invention will be explained below. FIG. 11 is a front view in which the cooling system of the ninth embodiment is viewed from the front of a vehicle. In this connection, similar reference characters are used to indicate similar parts in the second embodiment (shown in FIG. 4) and the ninth embodiment, and the explanations are omitted here.

In this embodiment, the radiator 9 for electric parts use and the condenser 12 are arranged differently from the second embodiment. As shown in FIG. 11, in the case where the condenser 12 is a so-called sub-cool condenser, the radiator 9 for electric parts use and the condenser 12 may be arranged in the traverse direction of the vehicle.

Figure 12:
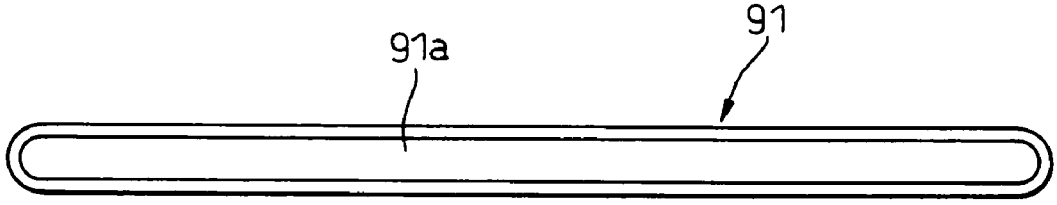
FIG. 12 is a view showing a cooling water tube in a cooling system according to the tenth embodiment.

The tenth embodiment of the present invention will be explained below. FIG. 12 is a view showing a cooling water tube in a cooling system according to the tenth embodiment, and FIG. 13 is a view showing a refrigerant tube in a cooling system according to the tenth embodiment.

As a cooling water tube 91 in the radiator 9 for electric parts use in each of the above embodiments, a flattened tube may be used, which is made by bending an aluminum sheet to be tubular and having a flattened cross section, as shown in FIG. 12. This cooling tube 91 comprises one cooling water passage 91*a* in which a cooling water flows.

Figure 13:
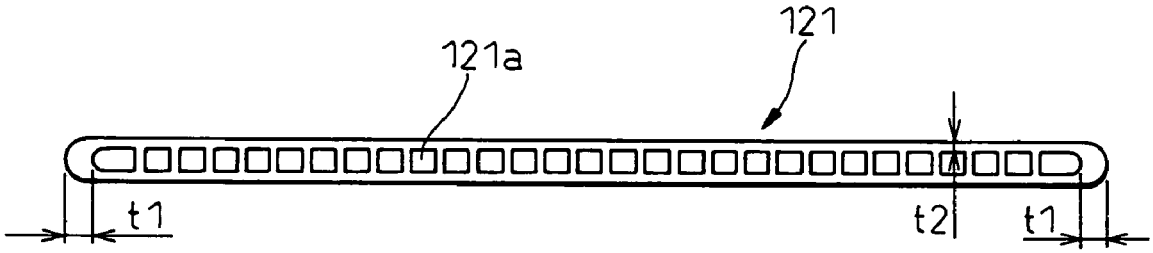
FIG. 13 is a view showing a refrigerant tube in a cooling system according to the tenth embodiment.

Also, as a refrigerant tubes 121 in the condenser 12 in each of the above embodiments, a so-called flat perforated tube is used, as shown in FIG. 13.

In this refrigerant tube 121, multiple refrigerant passages 121*a* are formed through extrusion or drawing of an aluminum material to be parallel with each other.

Also, in this refrigerant tube 121, the wall thickness t1 measured in the air-flow direction in this refrigerant tube 121 is larger than the wall thickness t2 measured in the tubes-laminated direction in this refrigerant tube 121.

In this connection, in case the radiator 9 for electric parts use is disposed below the condenser 12, air-flow direction side of the refrigerant tube 121 in the condenser 12 is likely to be hit by pebbles from a road surface.

In the refrigerant tube 121 in this embodiment, the refrigerant tube 121 is hard to be broken even if pebbles from a road surface hits the condenser 12 (chipping). Because the portion which is easy to be hit by pebbles from a road surface is thick and that this tube 121 is made of a so-called perforated tube, which has a high strength.

Figure 14:
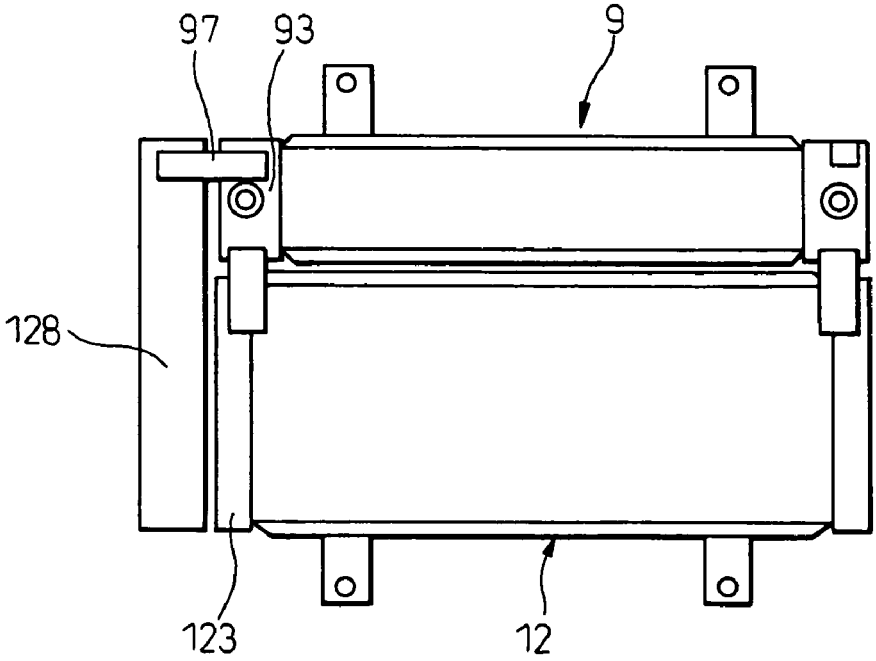
FIG. 14 is a view showing a cooling system according to the eleventh embodiment as viewed from front of the vehicle.
Figure 15:
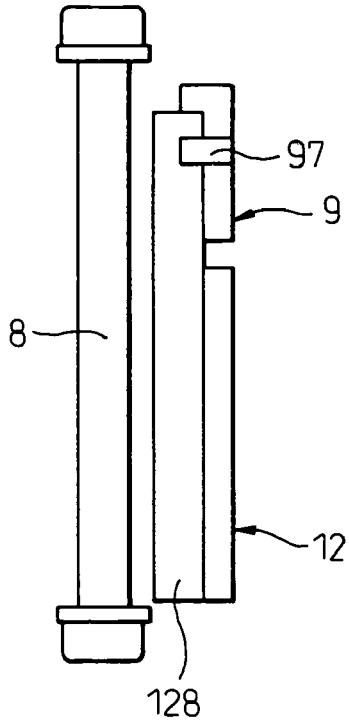
FIG. 15 is a left side view.

The eleventh embodiment of the present invention will be explained below. FIG. 14 is a view showing a cooling system according to the eleventh embodiment as viewed from front of the vehicle, and FIG. 15 is a left side view. In this connection, similar reference characters are used to indicate similar parts in the second embodiment (FIG. 4), and the explanations are omitted here.

A method of fixing of a modulator 128 according to this embodiment differs from that of the second embodiment. That is, provided that the radiator 9 for electric parts use is arranged in an upper portion of the condenser 12, and the modulator 128 is arranged on the sides of the condenser 12, and the modulator 128 is fixed to the condenser 12, and an upper portion of the modulator 128 protrudes upward with respect to an upper end face of the condenser 127, as shown in FIGS. 14 and 15, the radiator 9 for electric parts use and the modulator 128 will bend at substantially right angle with respect to their joint point when they are subject to a vehicle vibration so that an upper end portion of the modulator 128 will swing widely. As a result, the upper end portion of the modulator 128 can contact a radiator 8 for engine use, which is disposed rear of the modulator 128.

In order to counter this problem, according to this embodiment, a lower portion of the modulator 128 is joined to a header tank 123 of the condenser 12 by brazing, for example, and an upper portion of the modulator 128 is connected and fixed to a header tank 93 of the radiator 9 for electric parts use via a bracket 97. In this connection, the bracket 97 is brazed to both of the modulator 128 and the header tank 93.

According to this embodiment, because the upper portion of the modulator 128 is fixed to the header tank 93 of the radiator 9 for electric parts use, swing of the upper end portion of the modulator 128 due to a vehicle vibration is suppressed so that the modulator 128 can be prevented from contacting a radiator 8 for engine use.

Figure 16:
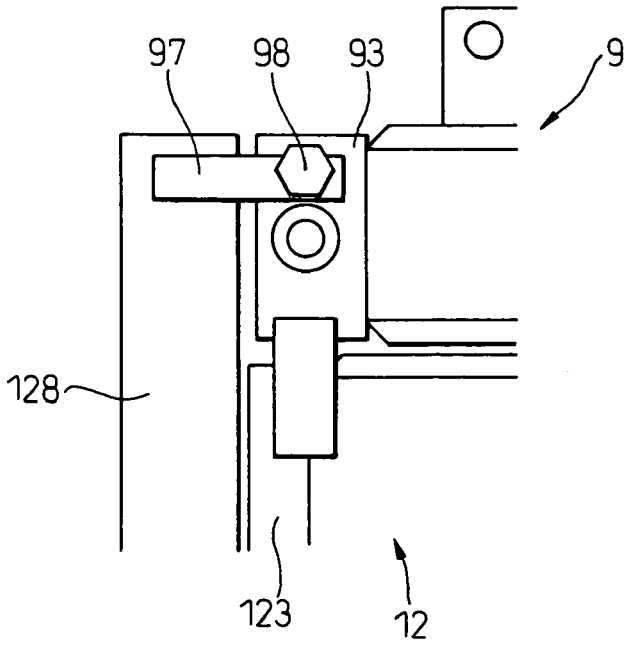
FIG. 16 is a front view showing a main portion of a cooling system according to the twelfth embodiment as viewed from front of the vehicle.

The twelfth embodiment of the present invention will be explained below. FIG. 16 is a front view showing a main portion of a cooling system according to the twelfth embodiment as viewed from front of the vehicle. In this connection, similar reference characters are used to indicate similar parts in the eleventh embodiment (FIGS. 14 and 15), and the explanations are omitted here.

Figure 17:
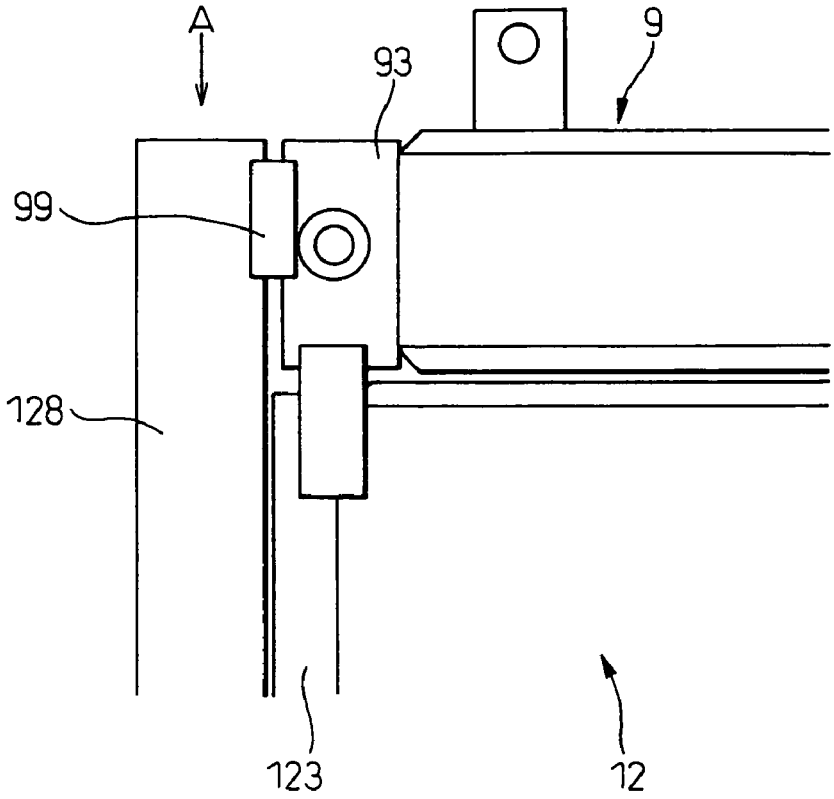
FIG. 17 is a front view showing a main portion of a cooling system according to the thirteenth embodiment as viewed from front of the vehicle.
Figure 18:
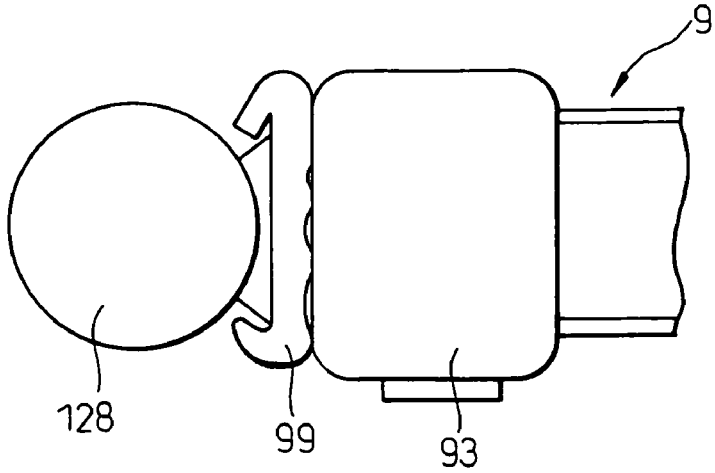
FIG. 18 is a view as seen in the direction A of FIG. 17.

While the bracket 97 and the header tank 93 of the radiator 9 for electric parts use are brazed in the eleventh embodiment, according to the twelfth embodiment, as shown in FIG. 16, the header tank 93 of the radiator 9 for electric parts use is provided with an embedded nut (not shown), and a bolt 98 is screwed into the embedded nut so that the bracket 97 and the header tank 93 of the radiator 9 for electric parts use are connected and fixed to each other The thirteenth embodiment of the present invention will be explained below. FIG. 17 is a front view showing a main portion of a cooling system according to the thirteenth embodiment as viewed from front of the vehicle, and FIG. 18 is a view as seen in the direction A of FIG. 17. In this connection, similar reference characters are used to indicate similar parts in the eleventh embodiment (FIGS. 14 and 15), and the explanations are omitted here.

While the bracket 97 is brazed to both of the modulator 128 and the header tank 93 of the radiator 9 for electric parts use, according to the thirteenth embodiment, as shown in FIGS. 17 and 18, the header tank 93 of the radiator 9 for electric parts use is brazed to an aluminum plate 99, and the plate 99 and the modulator 128 are engaged by caulking ends of the plate 99, as a result, the bracket 97 and the header tank 93 of the radiator 9 for electric parts use are connected and fixed to each other.

Finally, another embodiment will be explained below. The attaching bracket 95, 125 may be joined to the header tank 93, 123. Alternatively, the attaching bracket 95, 125 may be joined to the side bracket 94, 124.

While the invention has been described by reference to specific embodiments chosen for purposes of illustration, it should be apparent that numerous modifications could be made thereto, by those skilled in the art, without departing from the basic concept and scope of the invention.

The invention claimed is:

1. A cooling system in combination with a hybrid-powered automobile, the hybrid-powered automobile having an air conditioner for cooling air, which is blown into a vehicle compartment, by utilizing latent heat of evaporation of refrigerant, the hybrid-powered automobile being driven by a combination of a water-cooled engine and an electric motor, the cooling system for the hybrid-powered automobile comprising:

a radiator for the water-cooled engine of said hybrid-powered vehicle for exchanging heat between cooling water, which has cooled the water-cooled engine of said hybrid-powered vehicle, and air so as to cool the cooling water;

a radiator for electric parts of said hybrid-powered vehicle for exchanging heat between cooling water, which has cooled the electric parts of said hybrid-powered vehicle relating to control of the electric motor, and air so as to cool the cooling water; and a condenser for exchanging heat between the refrigerant at a high temperature and air so as to condense the refrigerant, wherein the radiator for the electric parts of said hybrid-powered vehicle and the condenser are arranged in parallel with each other with respect to a direction of air flow on an upstream side of the air flow of the radiator for the water-cooled engine of said hybrid-powered vehicle;

the radiator for the electric parts of said hybrid-powered vehicle includes a plurality of cooling water tubes, inside of which the cooling water flows and outside of which the air flows, and also includes a first cooling water header tank disposed at one end of the cooling water tubes and a second cooling water header tank disposed at an opposite end of the cooling water tubes, the condenser includes a plurality of refrigerant tubes, inside of which the refrigerant flows and outside of which the air flows, and also includes a refrigerant tank assembly comprising a first refrigerant header tank disposed at one end of the refrigerant tubes, the condenser further including a second refrigerant header tank disposed at an opposite end of the refrigerant tubes, the first cooling water header tank and the first refrigerant header tank are integrated with each other into a first integrated body;

the second cooling water header tank and the second refrigerant header tank are integrated with each other into a second integrated body;

the first and second cooling water header tanks are disposed at opposite ends of the plurality of cooling water tubes;

the first and second refrigerant header tanks are disposed at opposite ends of the plurality of refrigerant tubes;

a first pair of brackets for mounting the first and second integrated bodies to the automobile are mounted to the refrigerant tank assembly and the second refrigerant header tank, respectively;

a second pair of brackets for mounting the refrigerant tank assembly and the second integrated body to the automobile are mounted to the refrigerant tank assembly and the second cooling water header tank, respectively;

the condenser is disposed below the radiator for the electric parts of said hybrid-powered vehicle, the plurality of refrigerant tubes are formed in parallel, and wherein the plurality of refrigerant tubes are laminated and disposed so that air flows between the plurality of refrigerant tubes, and wherein in the refrigerant tube, a wall thickness measured in the air-flow direction in the refrigerant tube is larger than a wall thickness measured in the tubes-laminated direction in the refrigerant tube.

2. A combination according to claim 1, wherein the condenser includes a condenser portion for condensing gas-phase refrigerant, the refrigerant tank assembly includes a modulator for separating the refrigerant, which has flowed out from the condenser portion, into gas-phase refrigerant and liquid-phase refrigerant, and a sub-cooler portion for cooling the liquid-phase refrigerant which has flowed out from the modulator, and the radiator for electric parts of said hybrid-powered vehicle use is arranged on an upper portion of the condenser.

3. A combination according to claim 2 wherein one of the first pair of brackets and one of the second pair of brackets are mounted on the modulator.

4. A combination according to claim 2, wherein the modulator is arranged on a side of the condenser, and an upper portion of the modulator protrudes upward to a position adjacent the first cooling water header tank, and the upper portion of the modulator is fixed to the radiator for electric parts of said hybrid-powered vehicle, and a lower portion of the modulator is fixed to the condenser.

5. A combination according to claim 4 wherein one of the first pair of brackets and one of the second pair of brackets are mounted on the modulator.

* * * * *